US007320487B2

(12) United States Patent
Lee

(10) Patent No.: US 7,320,487 B2
(45) Date of Patent: Jan. 22, 2008

(54) CANCEL LEVER DEVICE FOR A DOOR HANDLE OF A MOTOR VEHICLE

(75) Inventor: Joel R. Lee, Homewood, IL (US)

(73) Assignee: Illinois Tool Works Inc, Glenview, IL (US)

( * ) Notice: Subject to any disclaimer, the term of this patent is extended or adjusted under 35 U.S.C. 154(b) by 0 days.

(21) Appl. No.: 11/511,636

(22) Filed: Aug. 29, 2006

(65) Prior Publication Data

US 2007/0029809 A1 Feb. 8, 2007

Related U.S. Application Data

(63) Continuation-in-part of application No. 10/739,593, filed on Dec. 18, 2003, now abandoned.

(51) Int. Cl.
*E05C 19/00* (2006.01)

(52) U.S. Cl. ..... 292/1; 292/DIG. 21; 292/DIG. 56

(58) Field of Classification Search ..... 292/336.3, 292/216, DIG. 21, DIG. 29, DIG. 56, DIG. 57, 292/1; 49/366; 296/146.9; 248/224.51
See application file for complete search history.

(56) References Cited

U.S. PATENT DOCUMENTS 4,073,519 A * 2/1978 Kurozu et al. ..... 292/216
4,358,141 A * 11/1982 Hamada ..... 292/216
5,033,234 A * 7/1991 Simon et al. ..... 49/367
5,673,597 A * 10/1997 Lin ..... 74/563
5,803,516 A * 9/1998 Hempel ..... 292/336.3
6,571,898 B2 * 6/2003 Guyomard ..... 180/68.4
6,588,960 B1 * 7/2003 Barwin et al. ..... 401/125
6,622,592 B2 * 9/2003 Lee ..... 74/563
6,752,440 B2 * 6/2004 Spurr ..... 292/336.3
6,779,820 B2 * 8/2004 Ogino ..... 292/216
6,783,551 B1 * 8/2004 Metzger et al. ..... 623/20.31
2002/0047279 A1 * 4/2002 Byrla et al. ..... 292/336.3

* cited by examiner

*Primary Examiner*—Gary Estremsky
(74) *Attorney, Agent, or Firm*—Mark W. Croll; Paul F. Donovan

(57) ABSTRACT

A cancel lever device is disclosed for a door handle mechanism of a motor vehicle. The device includes a cancelling portion having a first and a second side, the cancelling portion being pivotally secured relative to the door handle mechanism about a pivotal axis. The cancelling portion defines a leading edge and a biasing device is provided for biasing the leading edge such that in a first pivotal location thereof, the door handle mechanism is operable and in a second pivotal location of the leading edge, movement of the door handle mechanism is inhibited. The leading edge defines a channel and a bumper is disposed within the channel for cushioning movement of the cancelling portion when the leading edge moves from the second to the first location. The bumper includes a retaining protrusion which cooperates with the channel for retaining the bumper within the channel.

10 Claims, 7 Drawing Sheets

CANCEL LEVER DEVICE FOR A DOOR HANDLE OF A MOTOR VEHICLE

CROSS-REFERENCE TO RELATED APPLICATIONS

This application is a continuation-in-part of U.S. patent application Ser. No. 10/739,593 filed on Dec. 18, 2003, now abandoned.

FIELD OF THE INVENTION

The present invention relates to a cancel lever device for a door handle. More specifically, the present invention relates to a cancel lever device for a door handle of a motor vehicle.

BACKGROUND OF THE INVENTION

The present invention finds particular application in connection with third or back doors commonly found in trucks.

Typically, the front door of a truck holds a cancel lever shut so that the back door or third door of the truck cannot be opened from the inside unless the front door is first opened. The cancel lever, in effect, deactivates the latching mechanism used to open the back door so that the back door cannot be opened unless the cancel lever is released.

When the front door is opened, the cancel lever is released and allowed to swing open because it is spring biased.

However, when opening, the cancel lever typically hits the side of the door handle frame, thereby causing a loud banging sound. The present invention addresses this problem by providing a bumper for greatly reducing the sound generated by such movement of the cancel lever.

SUMMARY OF THE INVENTION

The cancel lever according to the present invention includes a cancelling portion having a first and a second side, the cancelling portion being pivotally secured relative to a door handle about a pivotal axis. The cancelling portion defines a leading edge and a biasing device is provided for biasing the leading edge such that in a first pivotal location thereof, the door handle is operable and in a second pivotal location of the leading edge, movement of the door handle is inhibited. The leading edge defines a channel and a bumper is disposed within the channel for cushioning movement of the cancelling portion when the leading edge moves from the second to the first location.

Other features and advantages of the present invention will become apparent to those skilled in the art upon review of the following detailed description, claims and drawings in which like numerals are used to designate like features.

Figure 1:
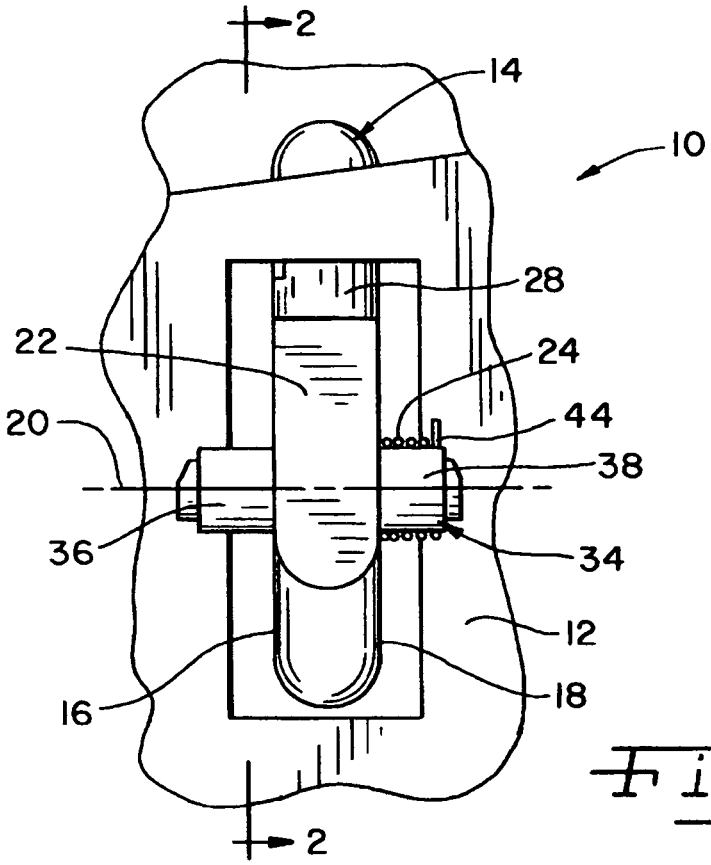
FIG. 1 is a side elevational view of a cancel lever device according to the present invention for a door handle mechanism of a motor vehicle.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENT

FIG. 1 is a side elevational view of a cancel lever device generally designated 10 according to the present invention for a door handle mechanism 12 of a motor vehicle. As shown in FIG. 1, the device 10 includes a cancelling portion or lever generally designated 14 having a first and a second side 16 and 18 respectively. The cancelling portion or lever 14 is pivotally secured relative to the door handle mechanism 12 about a pivotal axis 20. The cancelling portion 14 defines a leading edge 22, and a biasing device 24 is provided for biasing the leading edge 22.

Figure 2:
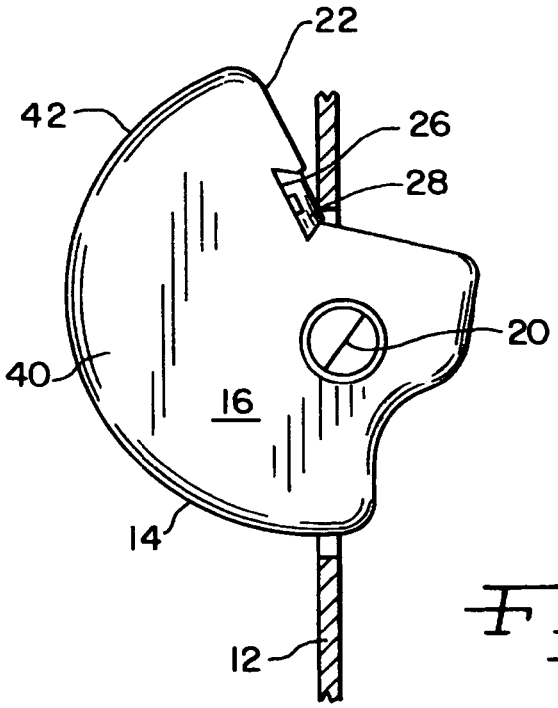
FIG. 2 is a view taken on the line 2-2 of FIG. 1.

FIG. 2 is a view taken on the line 2-2 of FIG. 1. As shown in FIG. 2, the cancelling lever 14 is disposed in a first pivotal location thereof so that the door handle mechanism 12 is operable.

Figure 3:
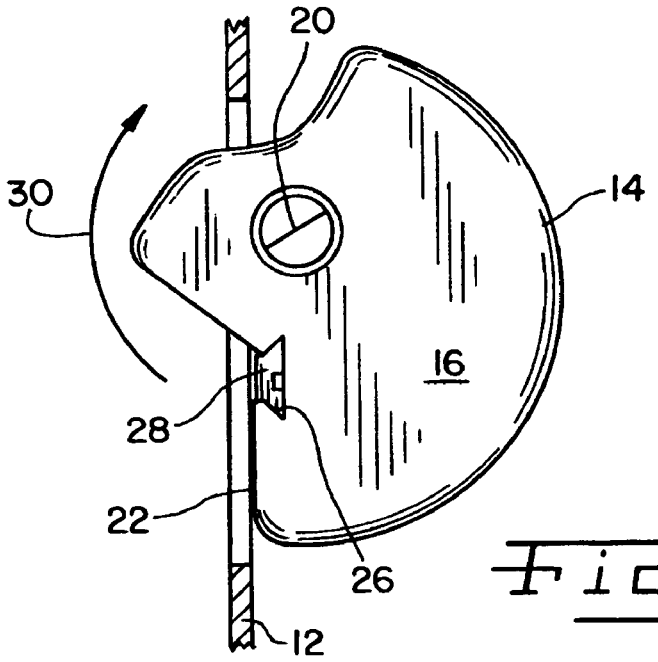
FIG. 3 is a similar view to that shown in FIG. 2 but shows the cancelling lever moved such that the leading edge is in a second pivotal location thereof so that movement of the door handle mechanism is inhibited.

FIG. 3 is a similar view to that shown in FIG. 2 but shows the cancelling lever 14 moved with the leading edge 22 in a second pivotal location thereof so that movement of the door handle mechanism 12 is inhibited. The leading edge 22 defines a channel generally designated 26 and a bumper generally designated 28 is disposed within the channel 26 for cushioning movement as indicated by the arrow 30 of the cancelling portion 14 when the leading edge 22 moves from the second location shown in FIG. 3 to the first location thereof as shown in FIG. 2.

Figure 4:
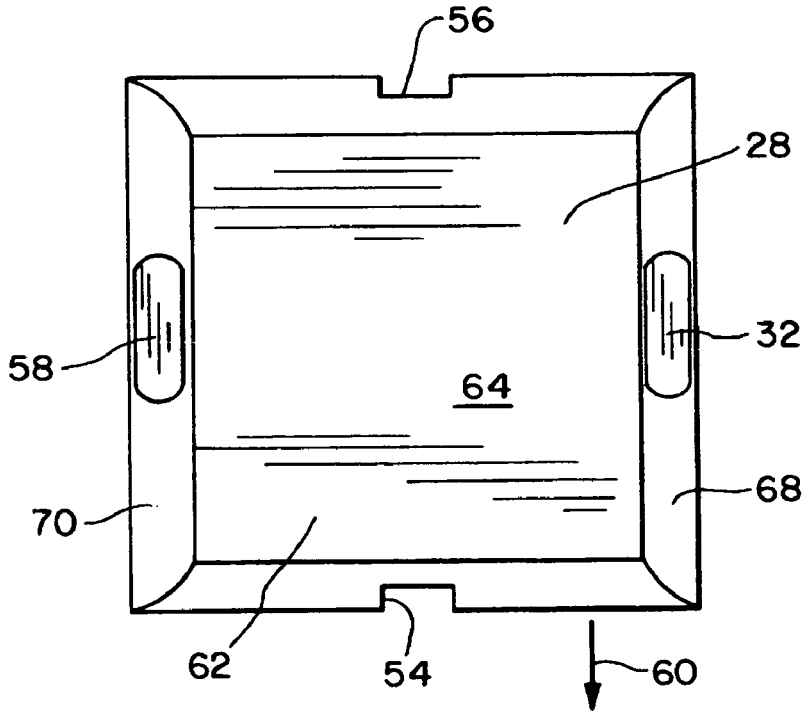
FIG. 4 is an enlarged top view of the bumper shown in FIGS. 1-3.

FIG. 4 is an enlarged top view of the bumper 28 shown in FIGS. 1-3. As shown in FIG. 4, the bumper 28 defines a retaining protrusion 32 which cooperates with the channel 26 for retaining the bumper 28 within the channel 26.

With reference to FIG. 1, the cancelling portion 14 includes an axle generally designated 34 for pivotally supporting the cancelling portion 14 relative to the door handle mechanism 12. The axle 34 includes a first trunnion 36 extending from the first side 16 of the cancelling portion 14.

A second trunnion 38 extends from the second side 18 of the cancelling portion 14. As shown in FIG. 2, the cancelling portion 14 includes a cam 40 which defines an eccentric cam surface 42. Also, it is noted that the leading edge 22 extends radially away from the pivotal axis 20. As shown in FIG. 1, the biasing device 24 includes a coil spring 44 with one of the trunnions 38 extending through the coil spring 44.

Figure 5:
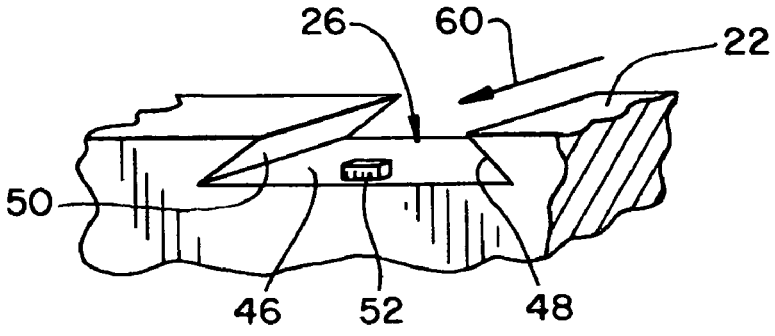
FIG. 5 is an enlarged perspective view of the channel shown in FIGS. 2 and 3.
Figure 6:
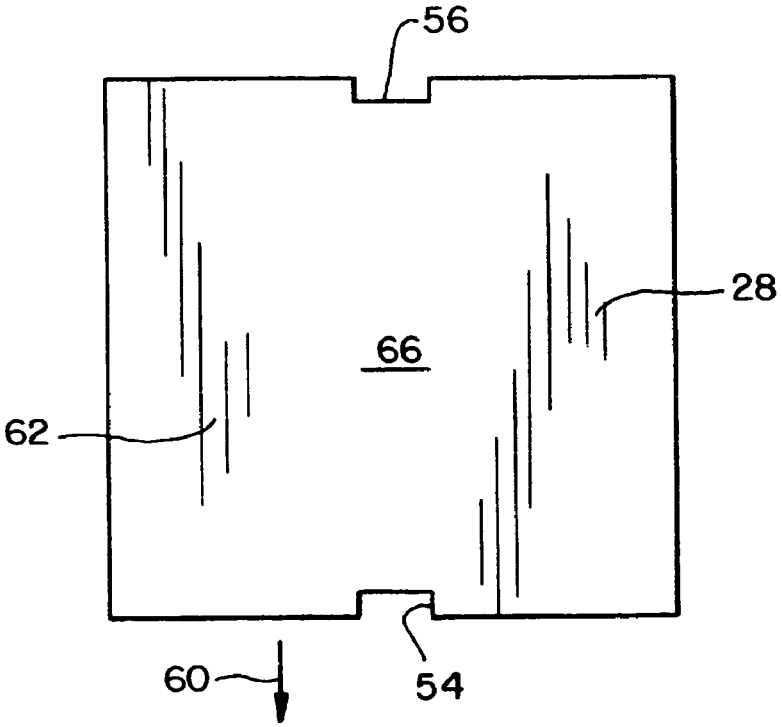
FIG. 6 is a bottom view of the bumper shown in FIG. 4.

With reference to FIGS. 2 and 3, the channel 26 is undercut. FIG. 5 is an enlarged perspective view of the channel 26. As shown in FIG. 5, the channel 26 includes a base 46 and a first undercut wall 48 which extends from the base 46. A second undercut wall 50 extends from the base 46 with the second undercut wall 50 being disposed opposite to the first undercut wall 48. The base 46 includes a positive stop 52 for locating the bumper 28. As shown in FIG. 4, the bumper 28 defines a positive stop channel 54 which cooperates with the positive stop 52 shown in FIG. 5, for locating the bumper 28 within the channel 26 of the leading edge 22. As shown in FIG. 4, the bumper 28 defines a further positive stop channel 56 which is disposed opposite to the positive channel 54 such that when the bumper 28 is assembled within the channel 26 of the leading edge 22, the positive stop 52 cooperates with one of the positive stop channels 54 or 56. The retaining protrusion 32 is adapted to cooperate with the first undercut wall 48. The bumper 28 preferably includes a further retaining protrusion 58 which cooperates with the second undercut wall 50. FIG. 6 is a view similar to the one shown in FIG. 4 but viewed from the bottom of the bumper 28. As shown in FIG. 6, the stop channels 54 and 56 permit assembly of the bumper 28 as indicated by the arrow 60 or alternatively in a direction opposite to that shown by arrow 60. The bumper 28 is preferably fabricated from a rubber compound such that when the leading edge 22 strikes the door handle mechanism 12, any sound generated is deadened by the bumper 28.

The bumper device 28 includes a body 62 having a first face 64 shown in FIG. 4 and a second face 66 shown in FIG. 6. The second face 66 is disposed opposite relative to the first face 64. The first face 64 has a first and a second sidewall 68 and 70 respectively as shown in FIG. 4, the first sidewall 68 being positioned parallel to the second sidewall 70. The first sidewall 68 includes the retaining protrusion 32 for restricting movement of the bumper device 28 relative to the cancel lever 10. Also, the second sidewall 70 includes the further retaining protrusion 58 for restricting movement of the bumper device 28 relative to the cancel lever device 10 such that when the bumper device 28 is assembled and retained relative to the cancel lever device 10, the sound generated by movement of the cancel lever device 10 is deadened.

In operation of the device, the bumper 28 is inserted into the channel 26 as indicated by the arrow 60 until the positive stop 52 is located within one of the stop channels 54 or 56 depending on the orientation of the bumper 28 when inserted. The provision of the two oppositely disposed stop channels 54 and 56 permits insertion of the bumper 28 either with the first or the second stop channel 54 or 56 leading. As the bumper 28 slides into the channel 26 as indicated by the arrow 60, the protrusions 32 and 58 engage the respective undercut walls 48 and 50 for further retaining the bumper 28 within the channel 26.

Figure 7:
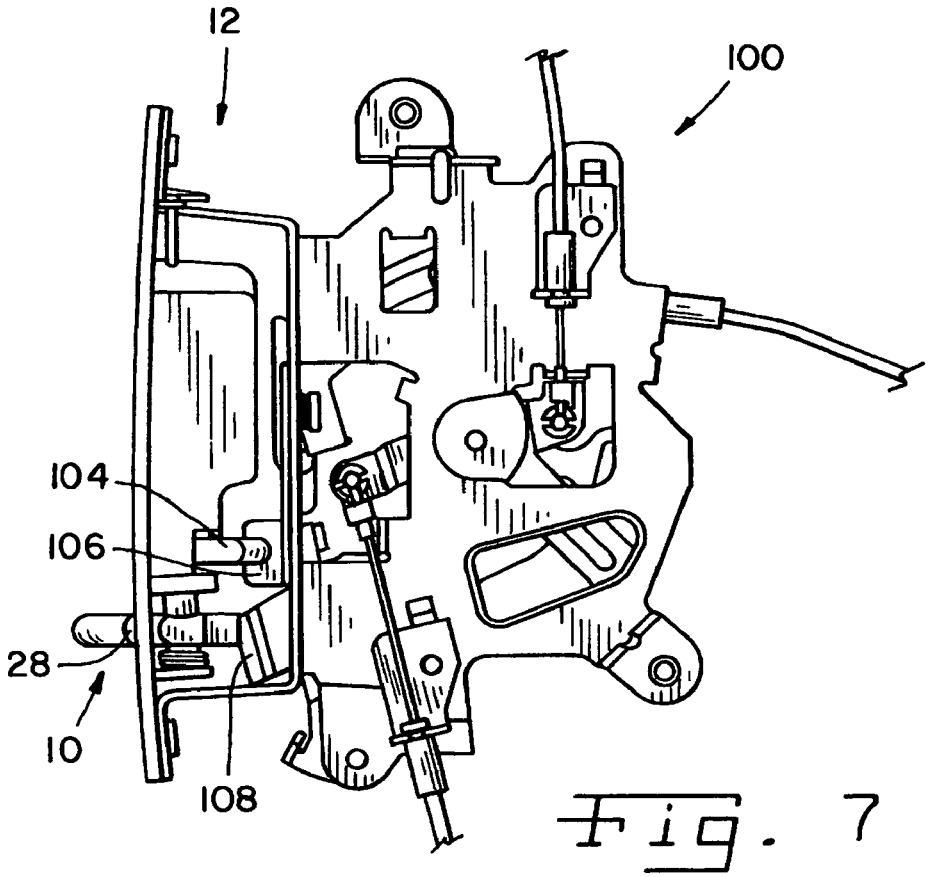
FIG. 7 is an elevational view of a door latch assembly having a cancel lever device in accordance with the present invention.

FIG. 7 illustrates cancel lever device 10 and door handle mechanism 12 in an overall door latch assembly 100, which includes additional levers, springs, cables and the like in interrelated operating cooperation to operate a vehicle door. Handle mechanism 12 includes a handle 102 (FIG. 8), movement of which operates a handle lever 104. Handle lever 104 operates directly against an initiating lever 106 which, as those skilled in the art will understand readily, is connected to other levers and cables of assembly 100 whereby unlatching a vehicle door can be initiated. A cancel lever 108 is disposed for direct operational contact by cancelling portion 14. Cancel lever 108 is associated with the other levers, cables and the like in assembly 100 such that, depending on the position of cancel lever 108, assembly 100 is either operable or inoperable. Specifically, with cancel lever 108 in a position more forward relative to handle mechanism 12, assembly 100 is operable upon movement of initiating lever 106 by handle lever 104. With cancel lever 108 in a position more rearward relative to handle mechanism 12, assembly 100 is inoperable upon movement of initiating lever 106 by handle lever 104. Cancel lever 108 is spring biased toward the forward position. Movement of cancelling portion 14 moves cancel lever 108 rearward or allows cancel lever 108 to move forward under the spring biasing force, depending on the position of cancelling portion 14.

FIGS. 8-16 illustrate the relative positions of handle lever 104, initiating lever 106, cancelling portion 14 and cancel lever 108 for various operational situations. For simplicity, other levers, springs, cables and the like in assembly 100 are not shown in FIGS. 8-16 so that initiating lever 106 and cancel lever 108 can be seen more clearly. While not shown directly connected one to another, it should be understood that initiating lever 106 and cancel lever 108 are operationally related through the other levers, springs, cables and the like in assembly 100.

Figure 8:
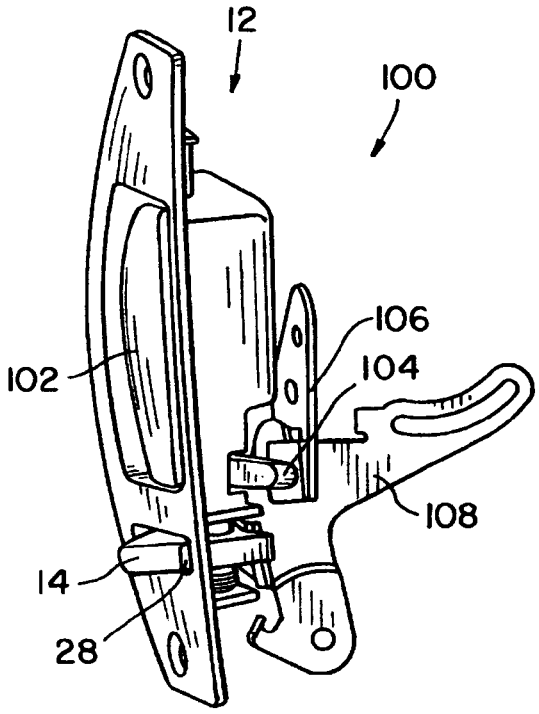
FIG. 8-FIG. 10 are fragmentary perspective, elevational and end views, respectively, of the door latch assembly in one operating condition.
Figure 9:
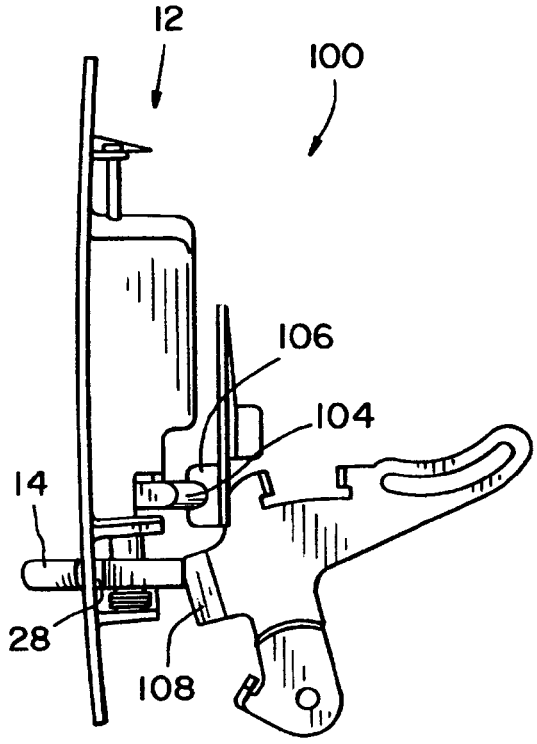
Figure 10:
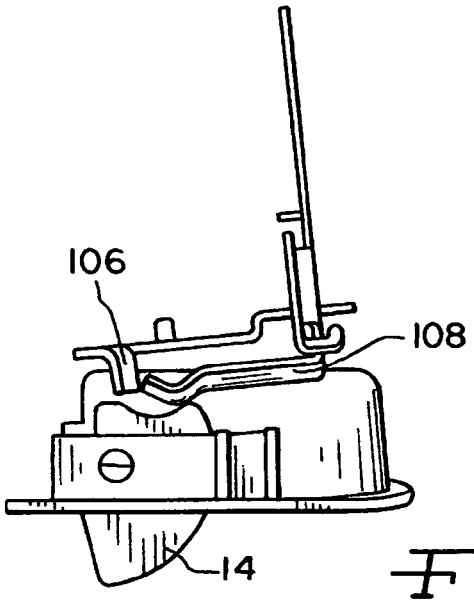
Figure 11:
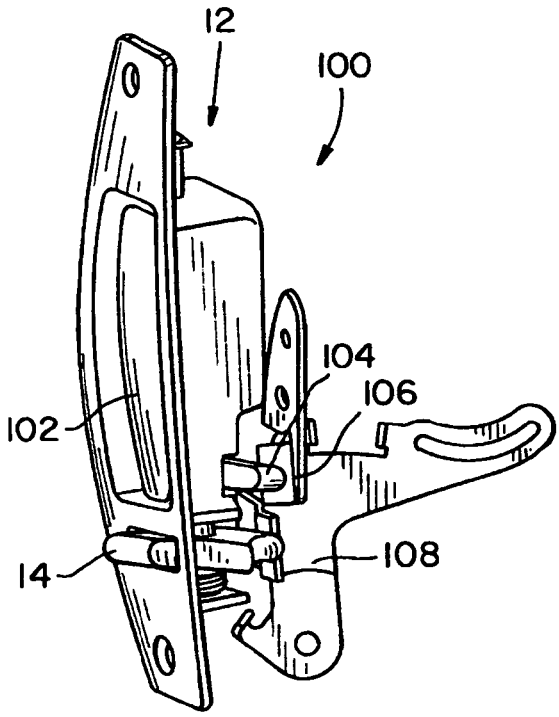
FIG. 11-FIG. 13 are fragmentary perspective, elevational and end views, respectively, of the door latch assembly in another operating condition.
Figure 12:
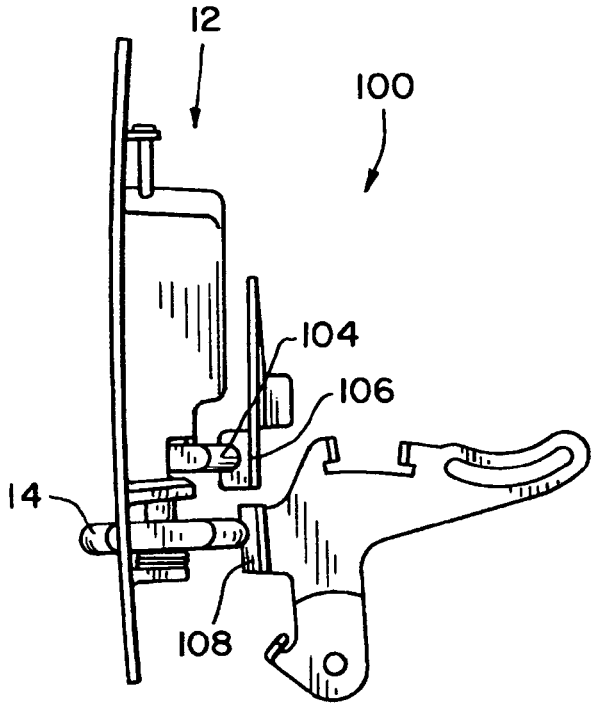
Figure 13:
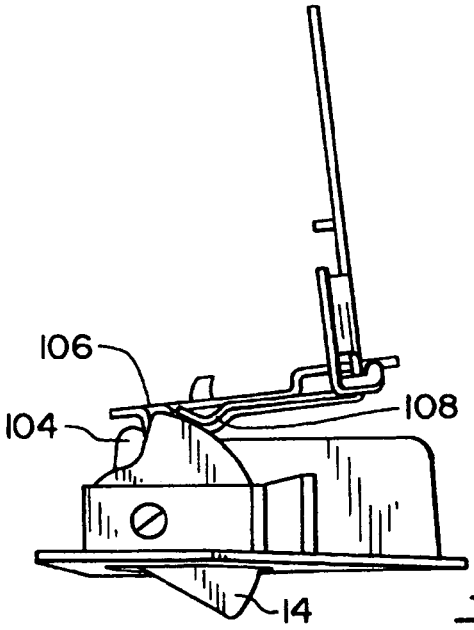
Figure 14:
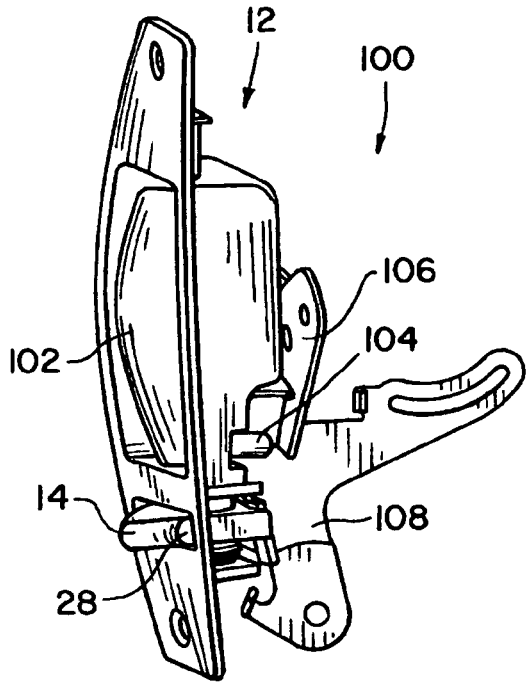
FIG. 14-FIG. 16 are fragmentary perspective, elevational and end views, respectively, of the door latch assembly in still another operating condition.
Figure 15:
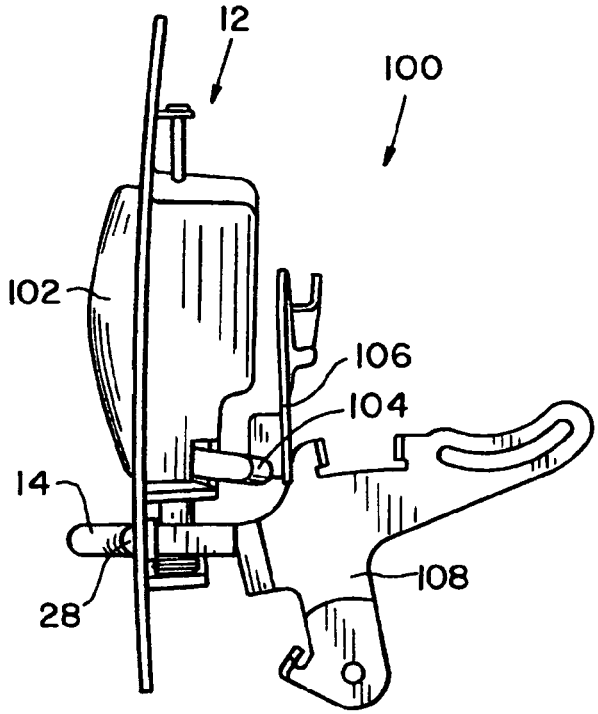
Figure 16:
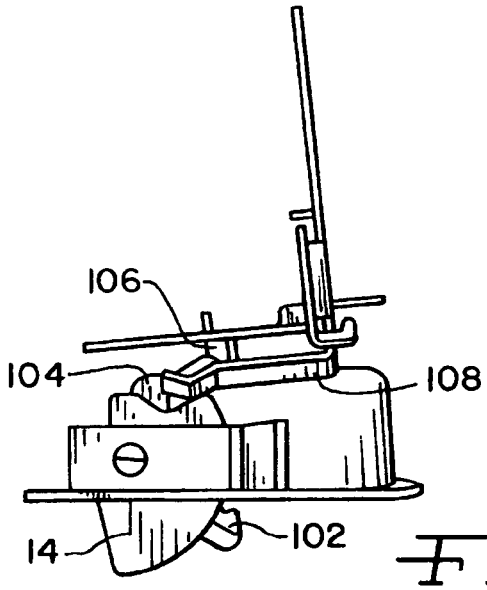

FIGS. 8, 9 and 10 illustrate a perspective view, a side elevational view and an end view, respectively, with assembly 100 in a condition in which the door can be opened. Cancelling portion 14 is rotated to a suitable position for operation, and cancel lever 108 is moved forward. FIGS. 11, 12 and 13 are similar perspective, elevational and end views except that cancelling portion 14 is rotated to a position for inhibiting door operation. Specifically, cancelling portion 14 by cam-like action has moved cancel lever 108 rearward, whereby assembly 100 is rendered inoperable. FIGS. 14, 15 and 16 illustrate perspective, elevational and end views of the various levers similar the FIGS. 8, 9 and 10, except that handle 102 has been moved for opening the door. Cancelling portion 14 is rotated to a position allowing cancel lever 108 to have moved forward, rendering assembly 100 operable. Handle 102 has been pivotally rotated outwardly, moving handle lever 104 against initiating lever 106 to initiate opening.

Figure 17:
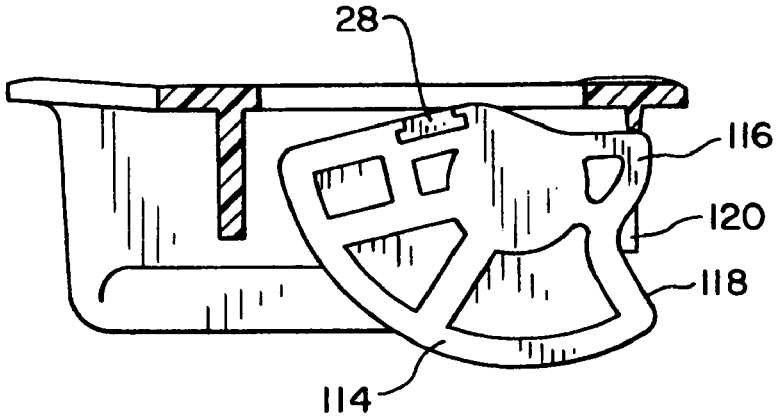
FIG. 17 is a plan view of an over-rotation prevention feature of the present invention.

FIG. 17 illustrates a cancelling portion 114 of a cancel lever device having a trailing edge 116 that includes an extension 118 for inhibiting over-rotation of cancelling portion 114 when extension 118 encounters a surface 120 of a door handle mechanism. As illustrated in FIG. 3, over-rotation can be inhibited without extension 118 as well, through the sizing of an opening through which cancelling portion 14 rotates.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art. Various features of the invention are set forth in the following claims.

What is claimed is:

1. A cancel lever device for a door handle mechanism of a motor vehicle, said device comprising:

a cancelling portion having a first and a second side, said cancelling portion being pivotally secured relative to the door handle mechanism about a pivotal axis, said cancelling portion defining a leading edge;

a biasing device for biasing said leading edge such that in a first pivotal location thereof, the door handle mechanism is operable and in a second pivotal location of said leading edge, movement of the door handle mechanism is inhibited;

said leading edge defining a channel having a base, a first undercut wall and a second undercut wall, said base defining a positive stop;

a sound deadening bumper disposed within said channel for cushioning movement of said cancelling portion when said leading edge moves from said second to said first location; and said sound deadening bumper defining a first retaining protrusion which cooperates with said first channel undercut wall, a second retaining protrusion which cooperates with said second undercut wall, and a positive stop channel which cooperates with said positive stop for locating and retaining said bumper within said channel.

2. A cancel lever device as set forth in claim 1, wherein said cancelling portion includes an axle for pivotally supporting said cancelling portion relative to the door handle mechanism.

3. A cancel lever device as set forth in claim 2, wherein said axle includes a first trunnion extending from said first side of said cancelling portion, and a second trunnion extending from said second side of said cancelling portion.

4. A cancel lever device as set forth in claim 1, wherein said cancelling portion includes a cam which defines an eccentric cam surface.

5. A cancel lever device as set forth in claim 1, wherein said leading edge extends radially away from said pivotal axis.

6. A cancel lever device as set forth in claim 3, wherein said biasing device includes a coil spring, and one of said trunnions extending through said coil spring.

7. A cancel lever device as set forth in claim 1, said second undercut wall being disposed opposite to said first undercut wall.

8. A cancel lever device as set forth in claim 1, wherein said bumper defines a further positive stop channel disposed opposite to said positive stop channel such that when said bumper is assembled within said channel of said leading edge, said positive stop cooperates with one of said positive stop channels.

9. A cancel lever device as set forth in claim 1, wherein said bumper is fabricated from a rubber compound such that when said leading edge strikes the door handle mechanism, any generated sound is deadened by said bumper.

10. A cancel lever device for a door handle mechanism of a motor vehicle, said device comprising:

a cancelling portion having a first and a second side, said cancelling portion being pivotally secured relative to the door handle mechanism about a pivotal axis, said cancelling portion defining a leading edge;

a biasing device for biasing said leading edge such that in a first pivotal location thereof, the door handle mechanism is operable and in a second pivotal location of said leading edge, movement of the door handle mechanism is inhibited;

said leading edge defining a channel, wherein said channel includes a base, a first undercut wall extending from said base, and a second undercut wall extending from said base, said second undercut wall being disposed opposite to said first undercut wall, said base including a positive stop;

a sound deadening bumper disposed within said channel for cushioning movement of said cancelling portion when said leading edge moves from said second to said first location, wherein said sound deadening bumper defines a positive stop channel which cooperates with said positive stop of said base of said channel for locating said sound deadening bumps within said channel of said leading edge, wherein said sound deadening bumper defines a further positive stop channel disposed opposite to said positive stop channel such that when said sound deadening bumper is assembled within said channel of said leading edge, said positive stop cooperates with one of said positive stop channels; and said sound deadening bumper defining a retaining protrusion which cooperates with one of said channel undercut walls for retaining said bumper within said channel.

* * * * *